US005717991A

United States Patent [19]

Nozaki et al.

[11] Patent Number: 5,717,991

[45] Date of Patent: Feb. 17, 1998

[54] DISPOSABLE SANITARY MASK

[75] Inventors: Satoshi Nozaki; Miki Takahashi, both of Ehime-ken; Yukitoshi Kubota, Kouchi-ken, all of Japan

[73] Assignees: Ni-Charm Corporation, Ehime-ken; Meisei Sansho Co., Ltd., Kouchi-ken, both of Japan

[21] Appl. No.: 757,862

[22] Filed: Nov. 27, 1996

[30] Foreign Application Priority Data

Nov. 30, 1995 [JP] Japan ..... 7-312782
Nov. 30, 1995 [JP] Japan ..... 7-312783

[51] Int. Cl.[6] ..... A62B 18/02

[52] U.S. Cl. ..... 2/9; 2/206; 128/206.13; 128/206.19

[58] Field of Search ..... 2/206, 9, 424, 2/174, 207; 128/206.12, 206.13, 206.16, 206.19, 206.21, 206.28, 863

[56] References Cited

U.S. PATENT DOCUMENTS

| | | | |
|---|---|---|---|
| 2,056,692 | 10/1936 | Roche | 128/206.13 |
| 2,237,305 | 4/1941 | Heimann | 128/206.13 |
| 2,447,450 | 8/1948 | Williams | 128/206.13 |
| 2,458,580 | 1/1949 | Fisketti et al. | 128/206.13 |
| 2,752,916 | 7/1956 | Haliczer | 2/206 |
| 4,084,585 | 4/1978 | Venaleck | 2/206 |
| 4,195,629 | 4/1980 | Halford | 128/206.13 |
| 4,941,470 | 7/1990 | Hubbard et al. | 128/206.13 |
| 5,025,506 | 6/1991 | Huang | 2/206 |
| 5,322,061 | 6/1994 | Brunson | 128/206.13 |

*Primary Examiner*—Amy B. Vanatta
*Attorney, Agent, or Firm*—Lowe, Price, LeBlanc & Becker

[57] ABSTRACT

A disposable sanitary mask comprises a covering panel section adapted to cover the wearer's nose and mouth and a pair of ear-looping panel sections which are respectively formed of nonwoven fibrous fabric. The covering panel section has a central rigid region formed vertically extending across a front surface thereof and side rigid regions defined vertically extending across the front surface thereof, a rigidity of these regions being higher than that of the remaining region of the covering panel section. Therefore, the mask can keep at least the covering panel section from losing its shape.

7 Claims, 2 Drawing Sheets

DISPOSABLE SANITARY MASK

BACKGROUND OF THE INVENTION

The present invention relates generally to a disposable sanitary mask and more particularly to such a sanitary mask made of nonwoven fibrous fabric and suitable to be worn by physicians and nurses working in hospitals and operators working, for example, in food processing plants.

Disposable sanitary masks made of nonwoven sheet are generally well known. One example of the known masks comprises a covering section adapted to cover the wearer's nose and mouth and a pair of ear-looping sections, these sections being integrally formed by stamping each blank of mask out from a single sheet of stretchable foamed urethane or nonwoven fabric. Another example of the known masks comprises a nose and mouth covering cup molded from plastic material and a pair of ear-looping sections in the form of elastic bands connected to transversely opposite sides of the covering cup.

with the known masks as mentioned above, the ear-looping sections often hang down and entwine each other when the wearer intends to put on the mask and prevent the wearer from quickly putting on the mask because much time is taken to disentwine the ear-looping sections. On the production line of the masks also, the pair of ear-looping sections are apt to entwine each other and often raise a problem such that the masks can not be packaged unless the pair of ear-looping sections are disentwined. Furthermore, the masks using the sheet of urethane or nonwoven fabric are apt to stick one to another when they are stacked and can not be individually identified, so it is sometimes difficult to pick up the mask one by one from the stack.

SUMMARY OF THE INVENTION

Accordingly, it is a principal object of the invention to provide a disposable sanitary mask so improved that the covering section retains its shape and the ear-looping sections do not readily hang down and the individual masks do not stick one to another when they are stacked.

The object set forth above is achieved, according to the invention, by a disposable sanitary mask comprising:

a disposable sanitary mask, the mask being made of nonwoven fibrous fabric comprising:

a covering panel section configured and dimensioned to cover the wearer's nose and mouth and divided vertically at a central portion thereof into first and second covering panel sections being symmetrical with respect to said central portion and having transversely spaced apart inner and outer side edges;

first and second ear-looping panel sections transversely extending from the outer side edges of the first and second covering sections so as to be engaged around the wearer's ears and being symmetrical with respect to said central portion and having transversely spaced apart inner and outer side edges;

the first and second covering panel sections being joined together along the inner side edges thereof so that said inner side edges define a first rigid region convexly on a front surface of the mask;

the first and second covering panel sections also having second rigid regions defined at least along the outer side edges thereof; and the first and second rigid regions having a rigidity higher than that of the remaining regions of the first and second covering panel sections.

DETAILED DESCRIPTION OF THE PREFERRED EMBODIMENT

Figure 1:
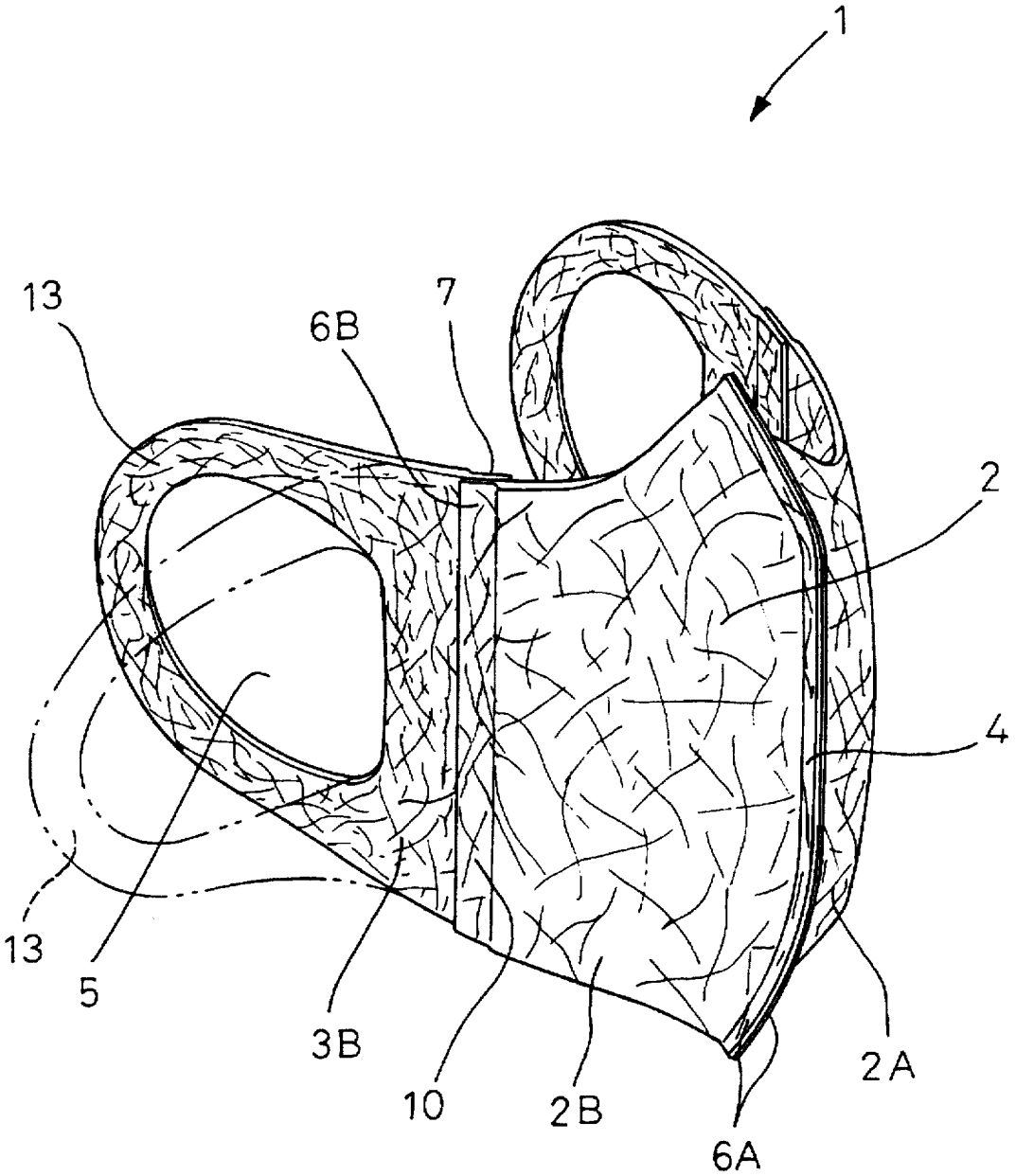
FIG. 1 is a perspective view showing a first embodiment of the invention.

A mask 1 perspectively shown by FIG. 1 as a first embodiment of the invention is made of nonwoven fibrous fabric and composed of a covering panel section 2, which comprises first and second covering panel sections 2A, 2B, configured and dimensioned to cover the wearer's nose and mouth, and first and second ear-looping panel sections 3A, 3B formed with openings 5 for being engaged around the wearer's ears. The mask 1 has a width gradually decreased from inner side edges 6A of the covering panel sections 2A, 2B toward outer side edges 13 of the ear-looping panel sections 3A, 3B. The covering panel sections 2A, 2B are symmetrical with respect to the inner side edge 6A which define a central portion of the covering panel sections 2A, 2B and the ear-looping panel sections are also symmetrical with respect to said central portion. The covering panel sections 2A, 2B are joined together along inner side edges 6A thereof to define a rigid region 4 convexly on a front surface of the mask 1. Outer side edges 6B of the covering panel sections 2A, 2B overlap inner side edges 7 of the ear-looping panel sections 3A, 3B, with the inner side edges 7 lying on rear surfaces of the covering panel sections 2A, 2B and, along these overlapping regions, these components are joined together to define rigid regions 10.

The covering panel sections 2A, 2B and the ear-looping panel sections 3A, 3B are made of soft nonwoven fibrous fabric containing thermoplastic synthetic fibers preferably of 60% or higher by weight. Along the rigid regions 4, 10, the respective sections 2A, 2B, 3A, 3B are heated under a pressure so as to be fused, and consequently, at least a thickness of the rigid regions 10 is smaller than that of the covering panel sections 2A, 2B in their overlapped condition. In this state, the rigid regions 4, 10 have lost their original fibrous appearances or forms and become film-like layers having a rigidity higher than in the remaining regions of the covering panel sections 2A, 2B as well as the ear-looping panel sections 3A, 3B. It should be understood that the rigidity of rigid region 4 may be higher or lower than that of the rigid regions 10.

With the mask 1 constructed as described above, the presence of the rigid regions 4, 10 of relatively high rigidity enables the covering panel section 2 to be held in a vertically extending posture, as illustrated. Accordingly, the ear-looping panel sections 3A, 3B made of relatively soft nonwoven fibrous fabric can be also held in a vertically extending posture at least in the proximity of the rigid regions 10. Should the ear-looping panel sections 3A, 3B hang down, extends of such hanging down will be limited to portions adjacent the outer side edges 13 of the ear-looping panel sections 3A, 3B as shown by imaginary lines. In this manner, the ear-looping panel sections 3A, 3B can be effectively prevented from entwining each other.

In general, the mask made of nonwoven fibrous fabric has been accompanied with the problem that the individual fibers in nonwoven fabric of each pair of adjacent masks readily entwine together when the masks are stacked and it is sometimes difficult to identify and pick up the individual masks one by one from the stack.

According to a first embodiment of the invention, however, the individual masks 1 will not entwine one with another even when they are stacked and will not make it difficult to identify and pick up the individual masks 1 one by one from the stack, because of the high rigidity and the small thickness of the rigid regions 4, 10. In addition, because at least covering panel section 2 can retain its shape due to the high rigidity of the rigid regions 4, 10, even when the masks 1 are stacked, the individual masks 1 can be easily identified and facilitate wearing as well as packing.

Figure 2:
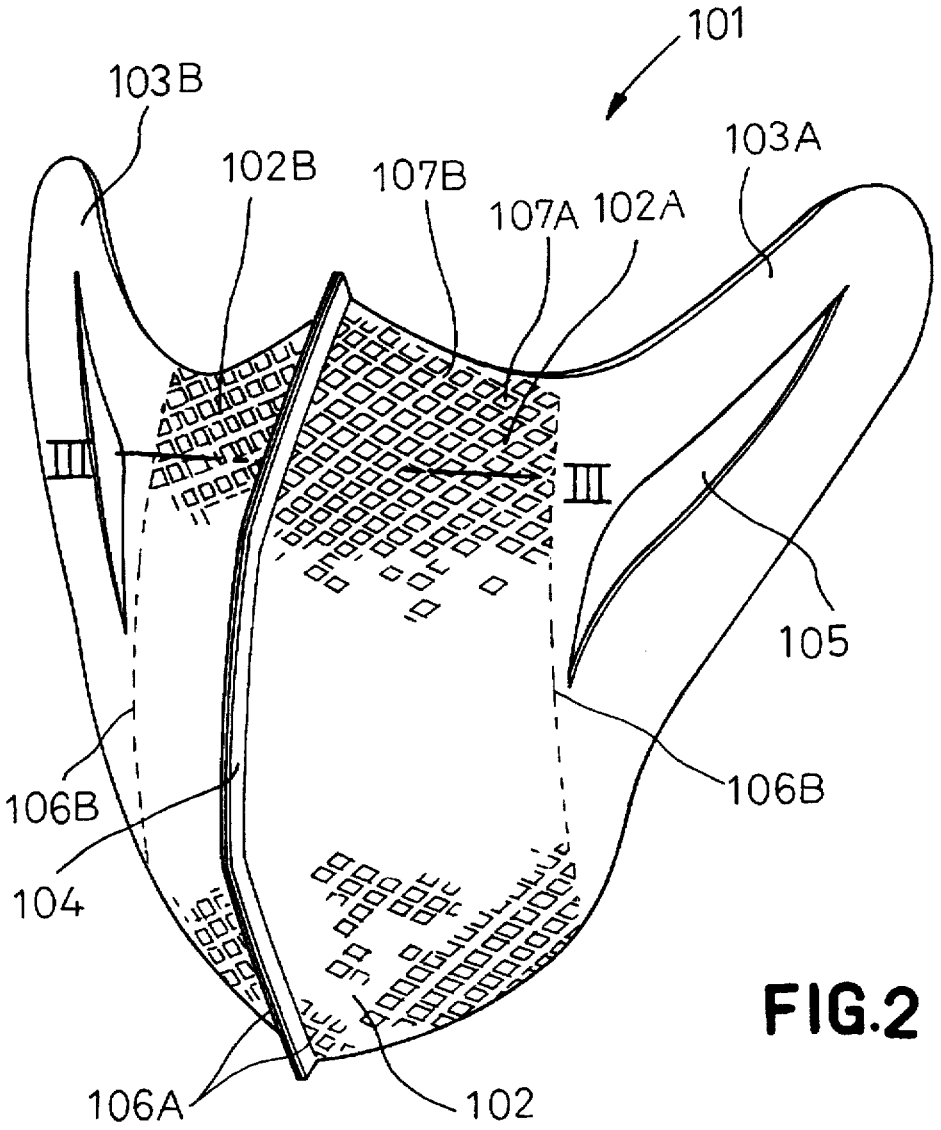
FIG. 2 is a perspective view showing a second embodiment of the invention.

A mask 101 perspectively shown by FIG. 2 as a second embodiment of the invention is made of nonwoven fibrous fabric comprising crimped thermoplastic composite fibers and being stretchable at least transversely of the mask 101. The mask 101 is composed of a covering panel section 102, which comprises a pair of first and second covering panel sections 102A, 102B, configured and dimensioned to cover the wearer's nose and mouth, and a pair of first and second ear-looping sections 103A, 103B integrally extending from outer side edges 106B of the covering panel sections 102A, 102B. The covering panel sections 102A, 102B are joined together along inner side edges 106A thereof to define a rigid region 104 convexly on a front surface of the covering panel section 102. The ear-looping panel sections 103A, 103B are provided with openings 105 defined by slits. Along the rigid region 104, the first and second covering panel sections 102A, 102B are heated under a pressure so as to be fused and, consequently, a thickness of the rigid region 104 is smaller than that of the first and second covering panel section 2A, 2B in their overlapped condition.

Figure 3:
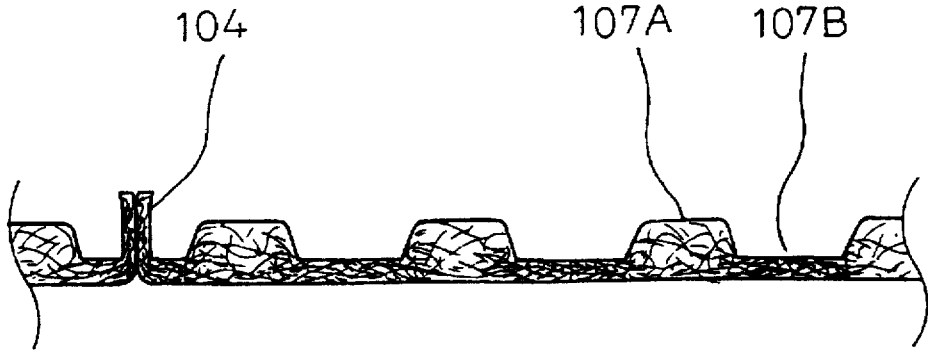
FIG. 3 is a sectional view taken along line III—III in FIG. 2.

FIG. 3 is a sectional view taken along line III—III in FIG. 2. Referring to FIGS. 2 and 3, the covering panel sections 102A, 102B are intermittently heated under a pressure over them so as to form a plurality of recesses 107A. At the recess 107A, most of the crimped composite fibers are welded or heat-sealed together and, in consequence, lose their original stretchability. As a result, the covering panel section 102A, 102B entirely exhibit a stretchability lower than in the ear-looping panel sections 103A, 103B and a rigidity higher than in the ear-looping panel sections 103A, 103B.

The mask 101 constructed as described above is preferably put on by the wearer with the ear-looping panel sections 103A, 103B being stretched transversely so that the covering panel section 102A, 102B transversely extend and are held only along its periphery in contact with the wearer's face. While the ear-looping panel sections 103A, 103B are stretched, the covering panel section 102A, 102B having a low stretchability and a high rigidity are scarcely stretched so that a convexity of the covering section 102 can be maintained. Consequently, a relatively large inner space is ensured around the nose as well as the mouth even with the mask 101 being put on and the wearer can easily breathe.

Both the shape of the individual recesses 107A and the arrangement of them may be selected so as to form a desired pattern in the covering panel section 102A, 102B. However, it is preferred to form the recesses 107A repeatedly not only in a vertical direction but also in a transverse direction on the covering panel sections 102A, 102B so as to leave a region 107B separating the individual recesses 107A one from another and substantially free from the effect of welding or heat-sealing treatment, because this region 107B allows the covering panel section 102A, 102B of a relatively low stretchability to keep an appropriate softness and thereby provides a good feeling to wear the mask 101.

According to the second embodiment of the invention, of the stretchable nonwoven fabric forming the covering panel section 102A, 102B and the ear-looping panel sections 103A, 103B, the part corresponding to the covering panel sections 102A, 102B are treated to have a relatively low stretchability so that a relatively large inner space can be ensured around the nose and the mouth and the wearer can easily breathe. Accordingly, the mask 101 is suitable to be worn by medical doctors and nurses working in hospitals or operators working, for example, in food manufacturing plants for relatively long time. It should be noted that the advantages of the mask 1 as set forth in the first embodiment of the invention will be substantially obtained also in the second embodiment of the invention.

What is claimed is:

1. A disposable sanitary mask, the mask being made of nonwoven fibrous fabric comprising:

a covering panel section configured and dimensioned to cover the wearer's nose and mouth and divided vertically at a central portion thereof into first and second covering panel sections being symmetrical with respect to said central portion and having transversely spaced apart inner and outer side edges;

first and second ear-looping panel sections transversely extending from the outer side edges of the first and second covering sections so as to be engaged around the wearer's ears and being symmetrical with respect to said central portion and having transversely spaced apart inner and outer side edges;

the first and second covering panel sections being joined together along the inner side edges thereof so that said inner side edges define a first rigid region convexly on a front surface of the mask;

the first and second covering panel sections having second rigid regions defined at least along the outer side edges thereof; and the first and second rigid regions having a rigidity higher than that of the remaining regions of the first and second covering panel sections.

2. A disposable sanitary mask according to claim 1, wherein each of the first and second ear-looping panel sections is formed separately from and joined to each of the first and second covering panel sections.

3. A disposable sanitary mask according to claim 1, wherein each of the first and second ear-looping panel sections is integrally formed with each of the first and second covering panel sections.

4. A disposable sanitary mask according to claim 1, wherein the first and second covering panel sections and the first and second ear-looping panel sections are formed of nonwoven fibrous fabric comprising thermoplastic synthetic fibers being stretchable at least transversely of the mask, and the transverse stretchability of the first and second covering panel sections is lower than that of the first and second ear-looping panel sections.

5. A disposable sanitary mask according to claim 4, wherein a rigidity of the first and second covering panel sections is higher than that of the first and second ear-looping panel sections.

6. A disposable sanitary mask according to claim 1, wherein a thickness of the first rigid region is smaller than that of the first and second covering panel sections in their overlapped condition.

7. A disposable sanitary mask according to claim 1, wherein the mask has a width gradually decreased from the inner side edges of the first and second covering panel sections toward the outer side edges of the first and second ear-looping panel sections.

* * * * *